US005819329A

United States Patent [19]

Doney et al.

[11] Patent Number: 5,819,329

[45] Date of Patent: Oct. 13, 1998

[54] VARIABLE CONTROL AIR VALVE AND FLUSH GATE FLAPPER

[76] Inventors: Dennis W. Doney, 213 Grand Ave., Aurora, Ill. 60506; Millard G. Lee, 184 Longfellow Dr., Wheaton, Ill. 60187

[21] Appl. No.: 562,525

[22] Filed: Nov. 24, 1995

[51] Int. Cl.[6] ..... E03D 1/14

[52] U.S. Cl. ..... 4/325; 4/404

[58] Field of Search ..... 4/324, 325, 388; 251/208

[56] References Cited

U.S. PATENT DOCUMENTS

| | | | |
|---|---|---|---|
| 420,327 | 1/1890 | Blessing | 4/345 |
| 2,741,776 | 4/1956 | Christie | 4/324 |
| 2,869,141 | 1/1959 | Koch et al. | 4/388 |
| 2,883,675 | 4/1959 | Hartman | 4/324 |
| 2,911,008 | 11/1959 | DuBois | 251/208 X |
| 3,324,482 | 6/1967 | Wustner | 4/325 |
| 3,331,084 | 7/1967 | Wustner | 4/325 |
| 3,341,168 | 9/1967 | Toeppen | 251/208 X |
| 3,365,730 | 1/1968 | Chiappetta | 4/325 |
| 3,858,250 | 1/1975 | Goglitore | 4/324 |
| 3,877,428 | 4/1975 | Seagle et al. | 251/208 X |
| 5,228,144 | 7/1993 | Kightlinger | 4/324 |
| 5,228,146 | 7/1993 | Martell | 4/406 |
| 5,259,074 | 11/1993 | Battle | 4/325 |

*Primary Examiner*—Robert M. Fetsuga

[57] ABSTRACT

A retrofit toilet flush system with an externally mounted variable control air valve that will precisely regulate the amount of water used in each flush cycle. A gallon indicator numbered one through six, in increments of no less than forty indexed portions, can be set. The air valve works in combination with a self-purging flapper to control condensation in the tube and air valve. The air valve consists of two simple bi-part molded custom parts assembled together with one of each of the following standard parts: a snap pin, o-ring, washer, and a lubricated wiping pad. All parts are made of non-metallic, corrosion-proof materials. No tools or special skills are required for the less than two minute installation time with no water shut-off.

6 Claims, 3 Drawing Sheets

Dennis W Doney
Millard G Lee

INVENTORS

VARIABLE CONTROL
AIR VALVE WITH
ONE CIRCULAR GROOVE

VARIABLE CONTROL
AIR VALVE WITH
TWO CIRCULAR GROOVES

Dennis W Doney
Millard G Lee

INVENTORS

CROSS SECTION OF
VARIABLE CONTROL
AIR VALVE WITH
ONE CIRCULAR GROOVE

CROSS SECTION OF
VARIABLE CONTROL
AIR VALVE WITH
TWO CIRCULAR GROOVES

Dennis W Doney
Millard G Lee

INVENTORS

VARIABLE CONTROL AIR VALVE AND FLUSH GATE FLAPPER

BACKGROUND—FIELD OF INVENTION

This variable control air valve and flush gate flapper is directed to a water closet metering device which conserves water by closing the flush gate flapper before all of the water is released from the toilet tank.

BACKGROUND—DESCRIPTION OF PRIOR ART

Heretofore many patents have been filed in the field of retrofit water saving devices for toilets. The majority of these never reached the manufacturing stage because of many basic faults in their design. As with U.S. Pat. No. 420,327 to Blessing Jan. 28, 1890, which contains over twenty metallic parts with many of its key components completely submerged in water. It appears that little consideration was given for the control of rust, corrosion, condensation, and electrolytic action giving question to reliability. This device was not a variable adjustment valve as it only had one present adjustment. As with U.S. Pat. No. 3,365,730 to Chiapetta Jan. 30, 1968 was of a similar design with an intricate push-pull handle; again, with only one preset adjustment. The valve was located inside the tank with a hand-adjusted needle valve where it is subjected to the effects of condensation and corrosion. Successful use requires the education of operator to properly manipulate the controls. Installation required the removal of the old flush handle, many of which are corroded, and replacement with the new valve-in-handle assembly which complicates the installation. Manufacturing and assembly cost would be high with this complex design, requiring expensive shaft drilling and plugging described on Page 3 Line 71–75 and Page 4 Line 1–4. As with U.S. Pat. No. 3,858,250 to Coglitore Jan. 7, 1975. This invention, though simple in design, lacks the following features for good commercial acceptance: The control valve is not located outside the tank. It shows no consideration for condensation control. It is not a variable design but a single setting. It uses a needle valve that will plug up with the smallest droplet of condensation. The valve is not easily cleaned. Commercial acceptance of any kind is unknown. As with U.S. Pat. No. 2,883,675 to Hartman Apr. 28, 1959 is the lowest cost, least complicated device that consists of a wing nut and screw pinching a flexible tube as a metering valve with only one delicate setting. This device is mounted on the overflow pipe, inside the tank, under water. This invention lacks convenience, condensation control, variability and corrosion resistance. As with U.S. Pat. No. 2,869,141 to Koch and Spalding Jan. 20, 1959. This device has five small metering ports with two o-rings giving only five fixed adjustments. No provisions are made for lubrication of the o-rings or cleaning of the small ports that may become clogged with condensation or other foreign matter. The valve assembly does not specify non metallic content for protection from electrolytic action and corrosion. The cost of manufacturing and assembly would be high since the device requires twenty complex molded, fabricated and machined parts.

The need for a reliable, inexpensive device to conserve toilet flush water is obviated by the National Energy Act of 1992. This act mandates that all new toilets manufactured in the United States or imported for residential use must be of a low-volume flush design. This means that toilets cannot use more than 1.6 gallons of water per flush. Most toilets manufactured prior to this act use five or six gallons of water per flush. These same toilets were designed to supply a more than adequate amount of water to the bowl to flush out the contents. A considerable amount of water can be conserved by retrofitting these toilets with a device to precisely adjust them to complete an adequate flush with a minimum amount of water. To accomplish this, a precision, variably adjustable device is essential to compensate for the different design of toilets, variations of water pressure and service installations.

Thus the need for a reliable, precision, variable, water-conserving toilet device that is convenient, easily installed and economical. This long-awaited, unsolved need for an economical, externally mounted, variable control air valve, that can be easily lubricated, is self-cleaning to reduce the possibility of clogging from foreign matter, rust, corrosion and electrolytic residue has not been shown in any other prior art.

For many decades investors and manufacturers have resisted the development of a retrofit, low flush toilet device. This was caused primarily by the failure of a design that would resolve all of the following requirements inclusively in one device: Precise, infinitely variable, externally mounted adjustable control, self-cleaning, easily lubricated, resistant to strong chemical toilet tank additives, adaptable to both flapper and ball type flush gate valves, easily manufactured, low cost, easily installed by a non-professional, convenient to use, controls condensation in valve and tube and free from the ravages of rust, corrosion and electrolytic action.

OBJECTS AND ADVANTAGES

Accordingly, several objects and advantages of our variable control air valve and flush gate flapper are:

(a) to provide a precision, variable control air valve conveniently located on the outside of the reservoir tank. To control flush water volume from one to six gallons in increments of no less than forty portions.

(b) to provide a specially designed flush gate flapper that will create a surge of reverse partial vacuum each time toilet is flushed in the water saving mode. As a result of this combination, a purging of any significant amount of condensation in the tube and variable control air valve is evacuated and drained to the toilet bowl.

(c) to provide a complete low flush water saving device that is void of all metal parts, thus eliminating electrolytic action.

(d) to provide a low flush retrofit water control device that is easy to install, in less than two minutes, without tools, special skills or requiring supply water shut off.

(e) to provide a control valve that clips in position without the need of bolts or clamps.

(f) to provide a single, easily accessible lubrication groove that will lubricate all surfaces within the control valve subject to any friction.

(g) to provide a lubricated wiping pad that will clean all of the internal surfaces of the control valve with one full revolution of the control knob.

(h) to provide a low flush device that can also be used in most federally mandated low flush toilets for even more water consideration.

(i) to provide a control valve with circular grooves in lieu of troublesome small diameter ports. These circular grooves being cleaned by a internal wiping pad with each full rotation of the control knob.

(j) to provide a control valve and mount that can be externally clipped on all sides of the toilet tank in a variety of convenient locations.

(k) to provide a device that is resistant to toilet tank additives, rust, and corrosion.

(l) to provide a low cost, reliable low flush retrofit device designed around a control valve consisting of only two simple, bi-part molded plastic parts, plus a standard snap pin, o-ring, water, and wiping pad.

Further objects and advantages are: To provide a low flush toilet device with a conveniently located, externally mounted variable control air valve which allows the operator three operation modes as follow: First; Precisely adjust the flush volume for a complete flush using the least amount of water. Second; To override this low volume flush without changing its setting by holding down the flush handle for a higher volume flush and releasing the handle as necessary. Third; rotate the control knob to a higher or full volume flush. Still further objects and advantages will become apparent from a consideration of ensuing description and drawings.

DRAWING FIGURES

Figure 6:
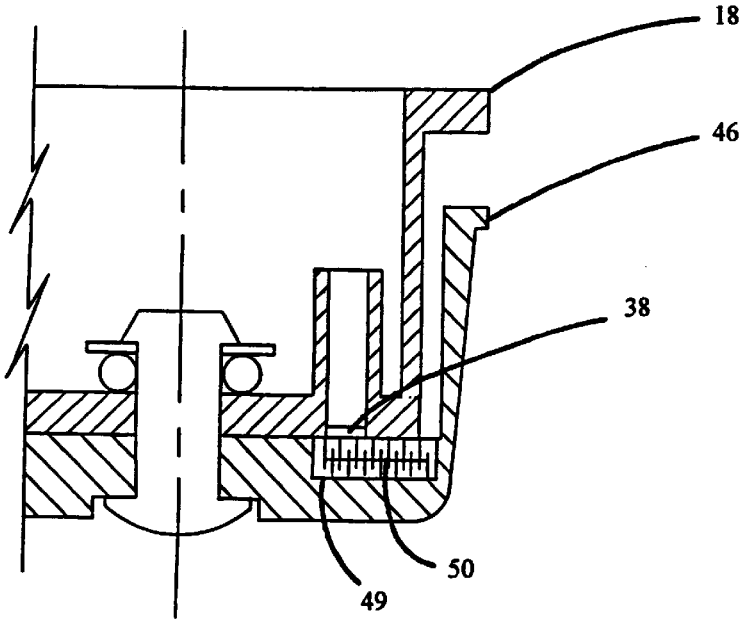

FIG. 6 Cross-section view of control knob 46 showing radial groove 49 with a single groove base unit 18.

Figure 7:
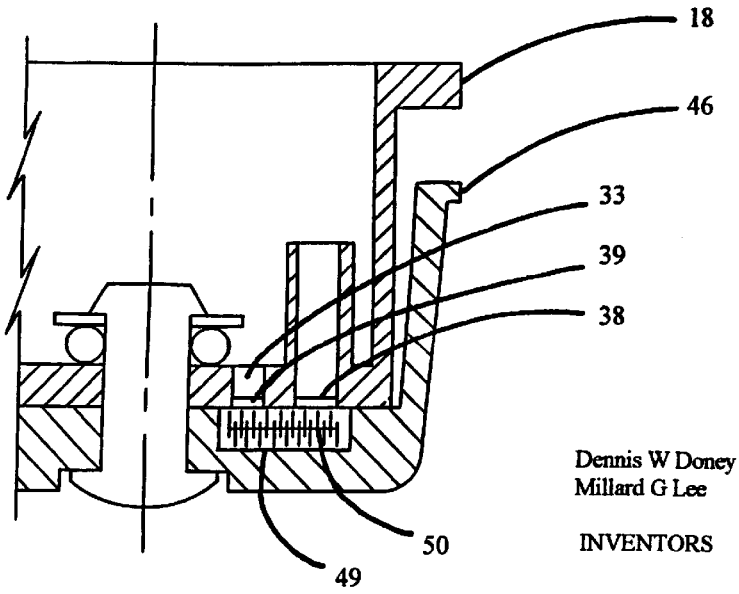

FIG. 7 Cross-section view of control knob 46 showing radial groove 49 with a double groove base unit 18.

REFERENCE NUMERALS IN DRAWINGS

10 Reservoir
11 Cover
12 Valve Seat
13 Discharge Pipe
14 Pivoted Handle
15 Arm
16 Link
18 Valve Base Unit
20 Flush Gate Flapper
21 Inner Chamber
22 Opening
23 Flapper Inner Surface
24 Tank Clip
26 Variable Control Air Valve
30 Horizontal Clip Bracket
31 Numerical Scale
32 Gallon Indicator Arrow
33 Atmosphere Vent
34 Exhaust Flange
35 Control Knob Metering Surface
36 Base Metering Surface
37 Tube
38 Inner Circular Groove
39 Outer Circular Groove
40 Tube Strap
42 Overflow Pipe
44 Hollow Fitting
46 Control Knob
48 Center Hole
49 Radial Groove
50 Lubricated Wiping Pad
52 Snap Pin
54 Washer
56 O-ring
58 Notches
60 Indexing Finger
61 Oil Slot
62 Inclined Groove

SUMMARY OF THE INVENTION

The present variable control air valve and flush gate flapper is a water-saving retrofit device that attached to a conventional reservoir tank water closet and provides the operator a way to control flush water volume. This control is made with a conveniently located variable control air valve clipped in place to the outside of the tank. The control valve is connected to the top of the toilet flush gate flapper by a tube. When the flush handle of the toilet is actuated by lifting the flush gate flapper, the trapped air inside the hollow flapper provides buoyancy and holds the flush gate flapper open. This trapped air tries to escape via the tube. The amount of air allowed to escape from the flush gate flapper, being displaced by water, determines the length of time it remains buoyant leaving the flush gate open. This controls the volume of flush water exiting the reservoir. The control valve meters the amount of escaping air by the use of a variable length circular groove. This is accomplished by two flat round disks preloaded together. One disk on the valve base unit has a entry port that allows exhaust air from the flush gate flapper to enter a circular groove. The other round disk on the inner surface of the control knob has a radial groove molded in its surface. This radial groove bridges the circular groove. This radial groove is vented to the atmosphere and acts as an exhaust port. The relative position of the radial groove and circular groove determines the distance air must travel in the circular groove varying the friction force of exhaust air. This variable control air valve design operates on the principles of air friction force. This friction force is a result of directing air along variable length grooves rather than through a small fixed or adjustable aperture such as needle valves. High resistance of escaping air results in a long, high water volume flush. Low friction force results in a short, low water volume flush.

Any design using small diameter tubing and restrictive air spaces gives importance to the need to control condensation and remove other foreign materials from these openings. A specially designed flush gate flapper with an inverted, pear-shaped interior contour solves the condensation problem. The pear-shaped design creates, with surprising results, a surge of partial vacuum when the flush gate flapper slams closed. The effect of inertia and gravity accelerate the exit of water through the controlled opening creating this surge of partial vacuum. The end result is the purging of any significant amount of condensation from the tube and control valve with the reverse-flow introduction of fresh, ambient room air through the control air valve.

A wiping pad indented in the control knob, cleans all of the functional surfaces of the valve of any foreign material with a full revolution of the control knob. Numbers one through six are shown on the control knob indicating the approximate gallons used per flush. Over forty indexing settings can be felt and heard by the operator for precise adjustments.

Lubrication of the two disk surfaces is accomplished by means of a slot in the control knob and an inclined groove in the top of the valve base unit. This groove is only large enough to contain the proper amount of lubricating liquid needed. Any excess liquid will simply overflow, off the control valve.

The simplicity of this design with the ability to lubricate and clean itself of any foreign materials and condensation is a vast improvement over all other prior art. No other prior art uses internally cleaned circular air resistance grooves as the design principle for air control in lieu of troublesome ports, needles, and other valves.

The novel design and exclusive use of noncorrosive materials in the device should result in enduring reliability regardless of the harsh environment in which it will be exposed.

Description—FIGS. 1 to 5

As is customary in reservoir tank water closets, an inlet water supply valve is provided. Since the inlet water supply valve and associated control systems are considered conventional and beyond the scope of this air valve and flapper, they have been omitted from the drawings in the interest of clarity.

Figure 1:
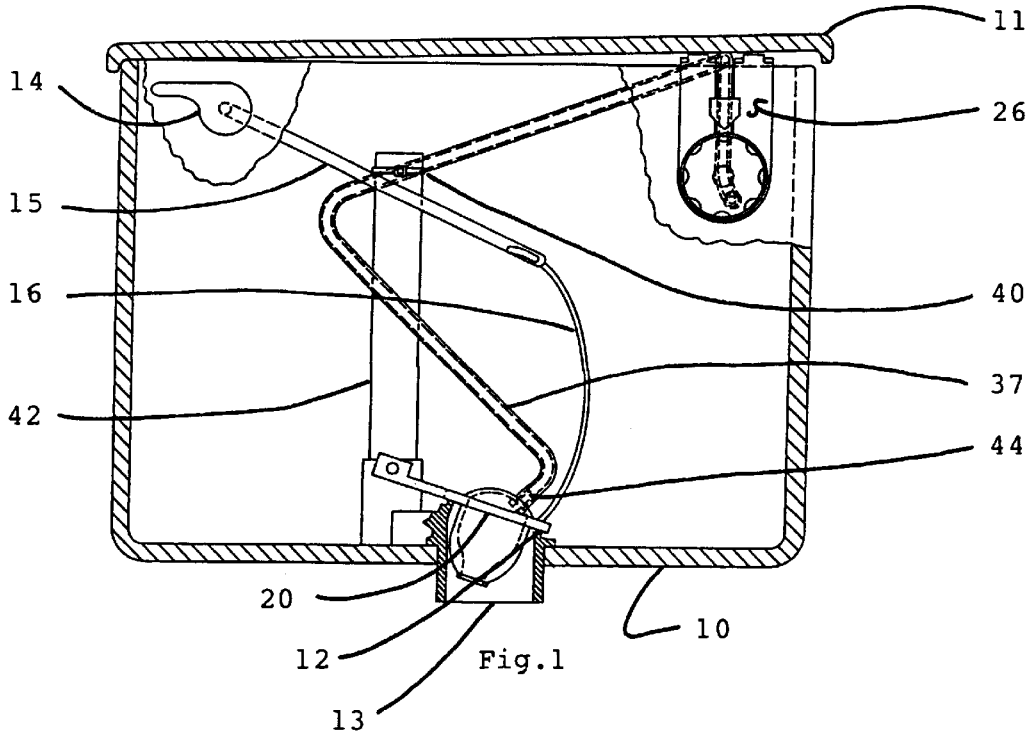
FIG. 1 is a view of a discharge flush gate valve mounted within a water closet and having a variable control air valve which is clipped to the reservoir wall.

All reservoir tank water closets have many types of operating mechanism to open or raise a flapper off of a seat. FIG. 1 shows one such operating mechanism including a pivoted handle 14 having an arm 15 connected to a link 16 between arm 15 and a flush gate flapper 20.

Figure 2:
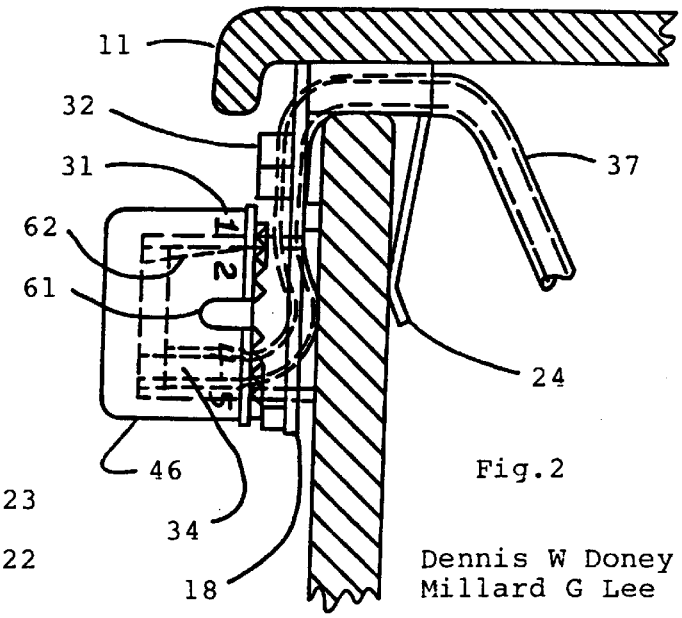
FIG. 2 is a partial sectional view of the water closet reservoir and the variable control air valve.
Figure 3:
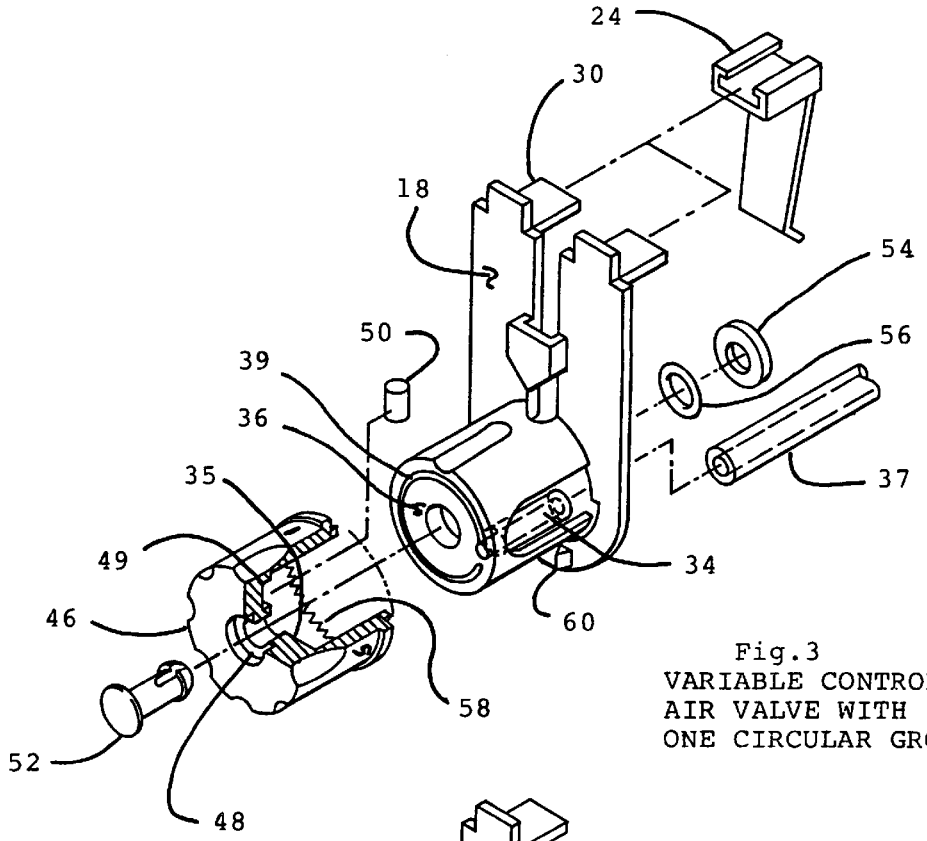
FIG. 3 is an exploded view of a variable control air valve having one circular groove.
Figure 4:
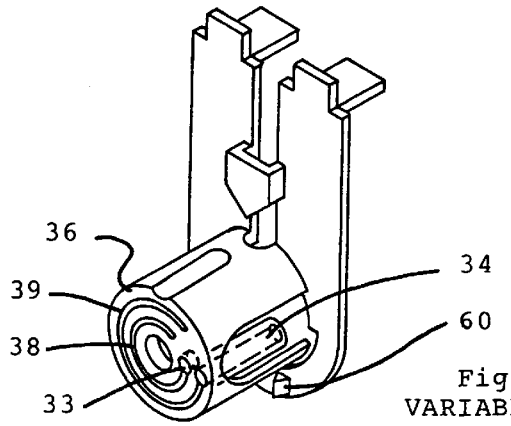
FIG. 4 is an exploded view of a variable control air valve having two circular grooves.

FIG. 1 shows that all reservoir tank water closets have a tank with an open top fitted with a heavy cover so it is desirable to adjust the controls for the discharge water from the exterior. Applicant accomplishes this exterior control by mounting a variable control air valve 26 on the outer surface of a reservoir 10. Air valve 26, the first embodiment, is connected to flapper 20, the second embodiment, via a tube 37. Starting from flapper 20, air follows a route through a hollow fitting 44, to tube 37. Tube 37 runs through a tube strap 40 which is attached to the top end of an overflow pipe 42. FIG. 2 illustrates tube 37 continuing between two tank clips 24, then over the top edge of reservoir 10, then under a gallon indicator arrow 32 that is molded to the front of a valve base unit 18, then to an exhaust flange 34 molded into the back to base unit 18. FIGS. 3 and 4 illustrate that exhaust flange 34 is further connected to an outer circular groove 39 molded into the face of a base metering surface 36.

FIG. 2 shows air valve 26 attached to the exterior wall of reservoir 10 by two tank clips 24. FIG. 3 shows each tank clip 24 snapped in place to a horizontal clip bracket 30 molded on the top of base unit 18. Tank clips 24 are made of a flexible material and grip the wall of reservoir 10 firmly. The weight of a cover 11 resting on top of tank clips 24 will add to the secure mounting of air valve 26. The thickness of each tank clip 24 is slightly in excess of the outside diameter of tube 37 positioned between them.

FIG. 3 illustrates air valve 26 with one outer circular groove 39 connected to exhaust flange 34. This groove is in the face of base metering surface 36. Outer groove 39 measures 1,78 mm wide by 0,30 mm deep encompassing 310 degrees of a circle. The last 50 degrees has no grooves which creates a blank area on base metering surface 36. A control knob 46 has a control knob metering surface 35 with a radial groove 49 of sufficient length to bridge from across outer groove 39 to over the outside edge of base metering surface 36 to the atmosphere. The detail of this venting is shown in FIG. 6.

FIG. 4 shows an alternate design feature . . . variable control air valve 26 with two circular grooves. Outer circular groove 39 connected to exhaust flange 34 and an inner circular groove 38 connected to an atmosphere vent 33. These grooves are in the face of base metering surface 36. Inner groove 38 runs parallel to the inside of outer groove 39 for 310 degrees of a circle. Inner groove 38 is 1,78 mm wide by 0,30 mm deep. Outer groove 39 is 1,78 mm wide and its depth is graduated in steps. The first 90 degrees is 0,53 mm deep. The second 90 degrees is 0,46 mm deep. The third 90 degrees is 0,38 mm deep. The next 40 degrees is 0,30 mm deep. The last 50 degrees has no grooves which creates a blank area on base metering surface 36. Control knob 46 has control knob metering surface 35 with radial groove 49 not vented to the atmosphere. Radial groove 49 is of a length only enough to bridge across inner groove 38 and outer groove 39. The use of two circular grooves allows for a smaller overall control valve size while increasing the variability of adjustment. The detail of radial groove 49 not vented to the atmosphere and atmosphere vent 33 are shown in FIG. 7.

Both valve base unit designs incorporate these features. FIG. 2 shows an oil slot 61 in the side of control knob 46 which aligns with an inclined groove 62 for lubrication of base metering surface 36 and control knob metering surface 35. FIG. 2 also shows arrow 32 molded to the front of base unit 18. Arrow 32 points to a numerical scale 31 on edge of control knob 46. Scale 31 is numbered consecutively #1 through #6 to indicate the approximate number of gallons used per flush. Position #6 corresponds to the blank area on base metering surface 36 which has no grooves. FIG. 3 shows a lubricated wiping pad 50 inserted in radial groove 49. A series of notches 58 molded in the edge of control knob 46 presses against an indexing finger 60 creating more than forth index settings. FIG. 3 also shows base unit 18 and control knob 46 pressed and held together a by snap pin 52 and a washer 54 compressing an o-ring 56 through a center hole 48.

Figure 5:
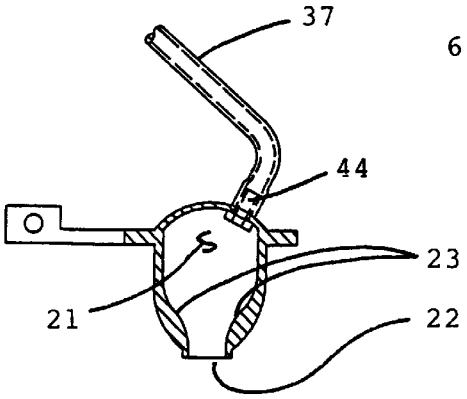
FIG. 5 is a view of a flush gate flapper, in particular, the predetermined internal specifications of the flapper.

FIG. 5 shows the details of flapper 20 that was specially designed to insure the control of condensation in air valve 26 and tube 37. Flapper 20 is made of a flexible material such as rubber or plastic and is hollow to form an inner chamber 21. Inner chamber 21 has an opening 22 at the bottom which is specifically designed with an opening 13,00 mm in diameter by 45,00 mm in length with the remaining interior contour following the shape formed by a flapper inner surface 23. This specific design shape forms inner chamber 21. A hole is made in upper surface of flapper 20 to accommodate hollow fitting 44. The design continues to maintain the identical exterior shape and size as a standard flush gate flapper so as to ensure compatibility with a valve seat 12 and a discharge pipe 13.

These specifications function well. However, many other combinations of length, width, and depth may be used.

Operation—FIGS. 1 to 5

FIG. 1 shows that when a pivoted handle 14 is pressed down, an arm 15 raises, pulls tension on a link 16, lifting a flush gate flapper 20 from a seat 12. Flapper 20 becomes submerged under water which traps air in an inner chamber 21 creating a buoyancy which holds flapper 20 open. Air allowed to exit, controlled by a variable control air valve 26, is displaced by water. The buoyancy of flapper 20 is reduced until it starts to sink. The out-rushing water flow from a reservoir 10 through a discharge pipe 13, forcefully slams flapper 20 closed on seat 12. FIG. 5 shows at that instance, the effect of inertia and gravity causes the water remaining in inner chamber 21 to rapidly exit down and be directed by an inner surface 23 through an opening 22. FIG. 1 shows this exit of water draws a reverse surge of dry ambient air through air valve 26 and a tube 37. The long-awaited solution of moisture control has been solved.

A water closet equipped with this variable control air valve 26 and flush gate flapper 20 will operate in three different modes:

1. Controlled, low-volume flush.
2. Manual override, higher-volume flush.
3. Standard, full-volume flush.

Mode 1: Controlled, Low-volume Flush

FIG. 3 shows air valve 26 with an outer circular groove 39. When handle 14 is pressed and released, flapper 20 is lifted from seat 12. Air trapped in inner chamber 21 escapes through hollow fitting 44, tube 37, and an exhaust flange 34 to outer circular groove 39, across a radial groove 49 to the outside edge of a base metering surface 36 to the atmosphere. When a control knob 46 with radial groove 49 is rotated, the distance the exhaust air must travel along outer groove 39 is varied. This changes the friction force creating an adjustable exhaust rate.

FIG. 4 shows variable control air valve 26 with two circular grooves. When handle 14 is pressed and released, flapper 20 is lifted from seat 12. Air trapped in inner chamber 21 escapes through hollow fitting 44, tube 37, and exhaust flange 34 to outer groove 39, across radial groove 49 and back through inner circular groove 38 to an atmosphere vent 33. When control knob 46 with radial groove 49 is rotated, the distance the exhaust air must travel along outer groove 39 and inner groove 38 is varied. This changes the friction force creating an adjustable exhaust rate.

Mode 2: Manual Override, Higher-volume Flush

A higher-volume flush can be achieved by simply pressing and holding handle 14 down. This will raise arm 15, hold tension on link 16 and prevent flapper 20 from reseating on seat 12 even through all the trapped air has been released from inner chamber 21 in flapper 20. Then user releases handle 14 when the desired flush volume has been achieved, which allows flapper 20 to reseat on seat 12.

Mode 3: Standard, Full-Volume Flush

A standard, full-volume flush can be achieved by rotating control knob 46 to position #6. No trapped air passes from flapper 20, tube 37 or air valve 26.

FIG. 2 shows an oil slot 61 in control knob 46 and an inclined groove 62 in a valve base unit 18. When control knob 46 is rotated to align oil slot 61 with inclined groove 62, lubrication can be applied. Inclined groove 62 holds only a predetermined amount of lubricant. Any excess simply overflows and off base unit 18. This avoids troublesome over-lubrication. Inclined groove 62 is tilted downward at the edge nearest the point of contact between base metering surface 36 and a control knob metering surface 35. Gravity allows applied lubricant to follow inclined groove 62 to this point and is drawn between these surfaces by capillary action and knob rotation. A small pool of lubricant remains in inclined groove 62 as a reserve for continued lubrication.

FIG. 3 shows that a complete 360 degree rotation of control knob 46 wipes base metering surface 36 with a lubricated wiping pad 50. This rotation of control knob 46 also moves a spring-loaded indexing finger 60 across a series of notches 58 creating a snapping sensation that can be heard and felt.

The end result of all of the above is an externally-mounted precision variable control air valve 26 and the specially designed flush gate flapper 20 that purges the valve and connecting tube each time the toilet is flushed in the low-volume flush mode.

Conclusion, Ramifications, and Scope of Invention

The reader will see that the combination of the variable control air valve and the self purging flush gate flapper provide a highly reliable, simple, low cost design that can be installed without any special skill or tools. In addition the use of a special cleaning lubrication pad and non-corrosive materials will insure its durability.

While the above description contains many specificities, these should not be construed as limitations on the scope of the variable control air valve and flush gate flapper, but rather as an exemplification of two preferred embodiments thereof. Many other variations are possible. For example the variable control air valve can be made smaller using multiple circular grooves with various angles and curves to increase or decrease air resistance. The key elements of the self purging flush gate flapper can also be adapted for the use in any ball type gate valve. Accordingly, the scope of the variable control air valve and flush gate flapper should be determined not by the embodiments illustrated, but by the appended claims and their legal equivalents.

We claim:

1. A variable control air valve for controlling the buoyancy of a flush gate flapper in a toilet tank, the flapper having an inner chamber, said air valve comprising:

(a) a valve base unit molded of rigid material and including a flat base metering surface having an outer circular groove thereon, said outer circular groove being concentric with a center hole in said base unit, said outer circular groove having a predetermined length, width and depth, said base unit further including an exhaust flange in communication with one end of said outer circular groove and means for mounting said base unit to the toilet tank;

(b) a rotatable cup-shaped control knob molded of rigid material and including a flat control knob metering surface on an inner side thereof of substantially the same size as said base metering surface, said control knob further including a radial groove in said control knob metering surface, means for connecting said radial groove to atmosphere and a wiping pad fitted into said radial groove;

(c) means for joining together said base unit and said control knob wherein said control knob metering surface and said base metering surface press against each other with said radial groove bridging said outer circular groove;

(d) means including a flexible tube for connecting said exhaust flange to the inner chamber of the flush gate flapper.

2. The variable control air valve in claim 1, wherein said connecting means includes an inner circular groove, said inner circular groove and outer circular groove being bridged by said radial groove.

3. The variable control air valve in claim 1, further comprising an indicator arrow, and a numerical scale on said control knob.

4. The variable control air valve in claim 1, further comprising an indexing finger and notches for indicating the position of said control knob relative to said base unit.

5. The variable control air valve in claim 1, further comprising an oil slot in said control knob and an inclined groove in said base unit for directing oil to said base metering surface, control knob metering surface and wiping pad.

6. A flush mechanism for use in a toilet tank, comprising:

(a) a flush gate flapper having an inner buoyancy chamber;

(b) a valve base unit molded of rigid material and including a flat base metering surface having an outer circular groove thereon, said outer circular groove being concentric with a center hole in said base unit, said outer circular groove having a predetermined length, width and depth, said base unit further including an exhaust flange in communication with one end of said outer circular groove and means for mounting said base unit to the toilet tank;

(c) a rotatable cup-shaped control knob molded of rigid material and including a flat control knob metering surface on an inner side thereof of substantially same size as said base metering surface, said control knob further including a radial groove in said control knob metering surface, means for connecting said radial groove to atmosphere, and a wiping pad fitted into said radial groove;

(d) means for joining together said base unit and said control knob wherein said control knob metering surface and said base metering surface press against each other with said radial groove bridging said outer circular groove;

(e) means including a flexible tube for connecting said exhaust flange to said inner chamber of said flush gate flapper.

* * * * *